United States Patent [19]

Walton

[11] 3,996,879

[45] Dec. 14, 1976

[54] REMINDER DEVICE FOR MEDICINE AND THE LIKE

[76] Inventor: Vilma E. Walton, 70 Hubbard Drive, Glastonbury, Conn. 06033

[22] Filed: Jan. 7, 1976

[21] Appl. No.: 647,139

[52] U.S. Cl. ..... 116/121; 206/534

[51] Int. Cl.[2] ..... H09F 9/00

[58] Field of Search ..... 206/534; 116/121, 133; 40/109, 111

[56] References Cited

UNITED STATES PATENTS 3,530,818 9/1970 Secondino ..... 116/121

3,739,740 6/1973 Fromer ..... 116/121

*Primary Examiner*—George T. Hall

[57] ABSTRACT

A reminder device having a band or collar which fits around a container and displays notations such as days or dates. A display unit with windows is mounted on the band or collar, and the display unit has a spring loaded and movable slide element to selectively cover a window and the notation associated therewith.

7 Claims, 8 Drawing Figures

FIG. 2
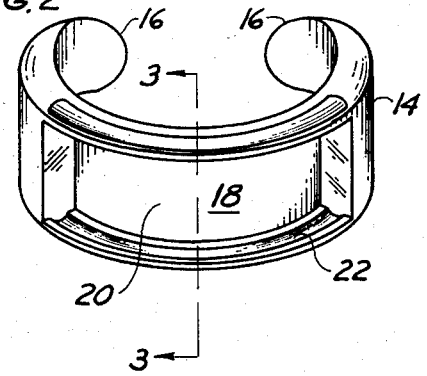
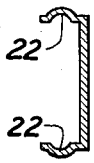
FIG. 3
FIG. 4
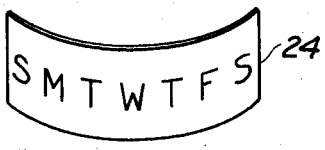
FIG. 1
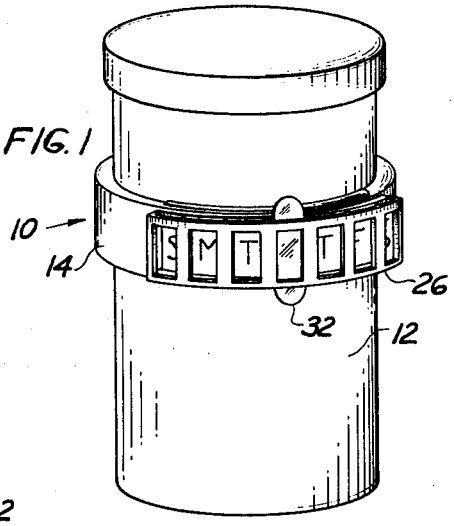
FIG. 5
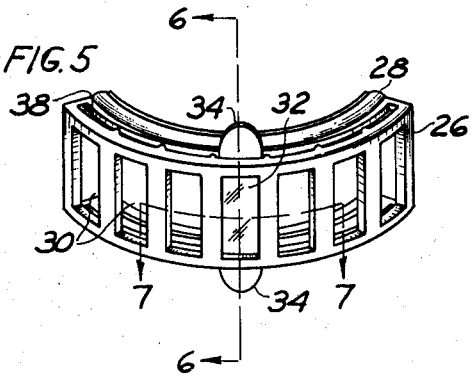
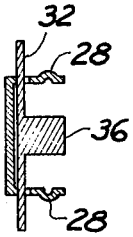
FIG. 6
FIG. 7
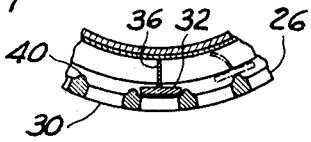
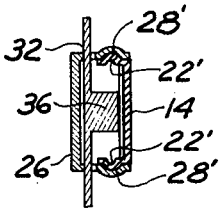
FIG. 8

REMINDER DEVICE FOR MEDICINE AND THE LIKE

BACKGROUND OF THE INVENTION

This invention relates to the field of reminder devices for medicine and the like. More particularly, this invention relates to a reminder device to be mounted on a container, such as a medicine or pill bottle, and serving to provide a reminder or temporary record of the date or time medicine was last taken or next due.

When required to take medicine on a certain daily or hourly schedule, many people have a problem in remembering when the medicine was last taken. This problem can range from a mere annoyance to a matter of serious concern depending on the circumstances and the medication involved. A particularly good example of this problem is found in the use of oral insulin pills which must be taken on a regular daily schedule. Serious health effects can be encountered if more than one pill is taken each day; and adverse, or at least what may be highly undesirable, effects can be encountered if the pill is not taken each day as required. Thus, it is not uncommon for a person who is, for example, taking oral insulin pills to be worrying because he or she can not remember whether they took their pill.

One common approach to the problem of medicine scheduling is to keep records, such as on a calendar or otherwise. However, this approach usually proves to be inadequate for several reasons. For example, it requires a separate step of marking a calendar or other record separate and apart from the handling of the medicine container.

Various suggestions have been made in the past to put reminder devices on medicine containers. These suggestions have usually suffered from one or more shortcomings, such as requiring special containers, or being elaborate and expensive, or being susceptible of being misread.

SUMMARY OF THE INVENTION

The present invention discloses a novel and improved reminder device which, among other things, is versatile, is easy to install and use, is convenient to use, and is reliable. Of particular importance is the fact that the reminder device of the present invention mounts directly on the medicine container, so there is a reminder to operate it each time the medicine is taken as part of the step of taking the medicine. Furthermore, operation of the reminder device of the present invention is accomplished simply by manually moving a slide device.

The reminder device of the present invention has a band or collar which fits around a bottle or other container. This band or collar contains a strip with an array of notations, such as days or time, and this strip may be replaceable. A window display unit is attached to the collar, with windows aligned with the notations in the array. A slide element is movable from window to window to selectively block out the notation aligned with a particular window. Thus, as the medicine is taken, on a daily basis for example, the slide element is moved to successively block out a notation for each day of the week. In this way the user will, for example, be reminded merely by glancing at the container as to when the last dose was taken and when the next dose is due.

Accordingly, one object of the present invention is to provide a novel and improved reminder device for use with medicines and the like.

Another object of the present invention is to provide a novel and improved reminder device that is mounted directly on a standard container with which it is to be used.

Still another object of the present invention is to provide a novel and improved reminder device which is versatile, is easy to install and use, is convenient to use, and is reliable.

Other objects and advantages will be apparent to and understood by those skilled in the art from the following detailed description and drawings.

BRIEF DESCRIPTION OF THE DRAWINGS

Referring now to the drawings, wherein like elements are numbered alike in the several figures:

FIG. 1 is a perspective view showing the reminder device of the present invention mounted on a typical pill container;

FIG. 2 is a front perspective view of the band or collar or the reminder device of the present invention;

FIG. 3 is a view along line 3—3 of FIG. 2;

FIG. 4 is a perspective view of a notation strip for use with the present invention;

FIG. 5 is a front perspective view of the display device of the present invention;

FIG. 6 is a side elevation view, in section, taken along line 6—6 of FIG. 5;

FIG. 7 is a top plan view, in section, taken along line 7—7 of FIG. 5; and FIG. 8 is a sectional side elevation view of an alternative configuration of the reminder device of the present invention.

DESCRIPTION OF THE PREFERRED EMBODIMENTS

Referring first to FIG. 1, the reminder device of the present invention, indicated generally at 10, is shown mounted on a standard type of pill container 12 of generally cylindrical shape. As can best be seen in FIG. 2 and 3, reminder device 10 has a band or collar 14 of arcuate shape, generally in the form of a circular arc. Collar 14 will typically be made of plastic material having some resilience or spring to it, and collar 14 will generally be of slightly smaller size than the container 12 on which it is to be mounted. Collar 14 is mounted on container 12 by spreading apart the open ends 16 of the collar and sliding the collar along the body of container 12 and then allowing the resilience of the material of collar 14 to clamp the collar to the container. Collar 14 has a generally rectangularly shaped elongated central opening 18 which forms a recess in which there is a back wall 20. The upper and lower walls of recess 18 have grooved sections 22 which form concave grooves facing inwardly toward recess 18.

An indicia strip (see FIG. 4) is mounted in recess 18 on back wall 20. Indicia strip 24 may simply be sized to fit into recess 18 and against back wall 20, or it may, if desired, contain a pressure sensitive adhesive on the back side to contact wall 20. Indicia strip 24 will bear an array of appropriate notations consistent with the schedule to be observed for taking the particular medicine involved. For example, as illustrated in FIG. 4, indicia strip 24 carries single letter notations which, from left to right, indicate the days of the week from Sunday through Saturday.

Referring now particularly to FIGS. 5, 6 and 7, the display unit portion 26 of the reminder device is shown. Display unit 26 is arcuate in shape corresponding to the curvature of collar 14, and it is sized and adapted to fit into recess 18 of the collar. Display unit 26 has rearwardly projecting upper and lower flanges, each of which has an outward convex projection 28. Display unit 26 is mounted in recess 18 merely by pushing the display unit into the recess so that projections 28 on the display unit deflect and snap into and engage grooves 22 in the collar; and it may be removed merely by pulling it to disengage projections 28 from grooves 22. Display unit 26 has an array of windows 30 equal in number to and coordinated with the notations on indicia strip 24. When display unit 26 is mounted in position in recess 18, each window lines up with one of the day letters on indicia strip 24. A slide element 32 mounted in display unit 26 functions to successively block out the notations on indicia strip 24. Slide element 32 is an elongated strip having finger engaging ends 34 projecting from the top and bottom of the slide element. Slide 32 may be of plastic or metal, and it has a rearwardly projecting integral leaf spring 36 which projects toward and bears against the indicia strip mounted on rear wall 20 of the collar. Slide 32 travels in slots 38 which are formed in the upper and lower flanges of display unit 26 to permit slide 32 to traverse the full arc length of the display unit. Also, as best seen in FIG. 7, the frame structure at each side of the window has an inwardly projecting ridge 40 to locate each successive step position of slide 32. Leaf spring 36 forces slide 32 against the rear surface of each window so as to retain the slide in position. Movement of the slide from one window to the next is accomplished merely by grasping projecting ends 34 and simultaneously pushing the slide sidewards and backwards. Leaf spring 36 deflects (see FIG. 7) to permit slide 32 to move from one window to the next, and the leaf spring then returns the slide to engage the rear frame portion of the next window between the ridges 40 thereof and hold the slide in position.

Referring again to FIG. 1, it can be seen that the front of display unit 26 projects forwardly of collar 14 when mounted in the collar. This forward extension or projection of display unit 26 permits the user to apply finger pressure to the ends 32 of slide 34 to move the slide from one window position to another. As shown in FIG. 1, the slide unit is blocking out the letter "W" representing Wednesday of the week. This indicates to the user of the pills in container 12 that Tuesday was the last day on which a pill was taken, and the pill must be taken on Wednesday. After taking the pill on Wednesday, the user would then activate slide 32 to move it to Thursday to provide a reminder that Thursdays pill has not been taken. Of course, as should be apparent, the individual user could vary the mode of his or her own operation of the reminder system so that the position of the slide could indicate the last day on which a pill was taken. If operated in this fashion, then the position of slide 32 as shown in FIG. 1 would indicate that the last pill was taken on Wednesday, and the slide would be moved to the right by the user when the next pill was taken on Thursday. Either of these operational modes can be selected by the user depending on the user's personal preferance. If desired, a notation could be placed on slide 32 to appear in the window in which the slide is positioned, and this notation could indicate, for example, that a pill is due to be taken on the day blocked out, or that a pill has been taken on the day blocked out.

Referring now to FIG. 8, a modified version of the reminder device of the present invention is shown. All of the elements shown in FIG. 8 correspond to the elements previously described with respect to FIGS. 2–7. The only difference is that the FIG. 8 device is sized and proportioned so that the rearwardly projecting flanges on display unit 26 have concave grooves 28' which snap onto convex projections 22' on collar 14. In other words, the FIG. 8 configuration differs from the previously described configuration in that the display device snaps into recess 18 in the previous device whereas the display device of FIG. 8 snaps onto the upper and lower surfaces of collar 14 to engage the collar.

As should be apparent from the foregoing description, operation of the reminder device of the present invention is easily accomplished at the same time as, and almost as an integral part of, the taking of the medication in question. At the same time that a person handles container 12 for the purpose of opening the cover and taking the medication, the person is automatically reminded to note and adjust the reminder device to establish and maintain an accurate history of medicine taking and to provide a reminder of the next dosage due.

When slide 32 has been indexed fully to the right to the symbol for Saturday, recycling for another weeks use is accomplished merely by moving slide 32 leftward to the left S symbol for Sunday.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. A reminder device for attachment to a medicine container, the reminder device including:

collar means for mounting on a medicine container;

indicia means having an array of notations for indicating a schedule for taking medicine;

display means mounted on said collar means for viewing said notations on said indicia means, said display means having a plurality of apertures aligned with notations on said indicia means; and selectively adjustable indicating means movably mounted in said reminder device, said indicating means being selectively positionable in the apertures in said display means.

2. A reminder device as in claim 1 wherein:

said collar means has a recess; and said indicia means is positioned in said recess.

3. A reminder device as in claim 2 wherein:

said display means is mounted in said recess.

4. A reminder device as in claim 3 wherein:

said recess includes mounting grooves; and said display means includes mounting projections for engaging said mounting grooves.

5. A reminder device as in claim 1 wherein:

said collar means includes mounting projections; and said display means includes mounting grooves for engaging said mounting projections.

6. A reminder device as in claim 1 wherein said indicating means includes:

slide means; and resilient means for urging said slide means toward said apertures.

7. A reminder device as in claim 6 wherein said resilient means includes:

leaf spring means bearing against said collar means.

* * * * *